United States Patent [19]

Myers et al.

[11] 4,042,221

[45] Aug. 16, 1977

[54] TILT MIXER

[76] Inventors: Claude K. Myers; Gary A. Myers; Phillip C. Myers, all of 8376 Salt Lake Ave., Bell, Calif. 90201

[21] Appl. No.: 463,109

[22] Filed: Apr. 22, 1974

[51] Int. Cl.[2] ..... B01F 7/00

[52] U.S. Cl. ..... 259/119; 259/41; 259/74

[58] Field of Search ..... B01F/15/02; B01F/13/00; 259/122, DIG. 1, DIG. 2, DIG. 5, DIG. 6, DIG. 18, 116, 118, 7, 5, 119, 91, 92, 81, 31–35; 68/242

[56] References Cited

U.S. PATENT DOCUMENTS

| | | | |
|---|---|---|---|
| 1,685,187 | 9/1928 | Aeschbach | 259/DIG. 1 |
| 1,733,945 | 10/1929 | Dehuff | 259/DIG. 1 |
| 1,928,950 | 10/1935 | O'Neill | 259/30 |
| 2,001,036 | 5/1935 | Prince | 259/DIG. 1 |
| 2,099,937 | 11/1937 | Lauterbur | 259/DIG. 1 |
| 2,872,562 | 2/1959 | McNamara | 259/DIG. 18 |
| 2,946,273 | 7/1960 | Hitzl | 259/81 R |
| 2,968,472 | 1/1961 | Barnett | 259/122 X |
| 3,164,378 | 1/1965 | Hager | 259/81 R |
| 3,224,741 | 12/1965 | Muench | 259/30 |
| 3,256,573 | 6/1966 | Hunter | 259/5 |
| 3,328,004 | 6/1967 | Beichle | 259/81 R |
| 3,342,459 | 9/1967 | Myers et al. | 259/104 |
| 3,779,520 | 12/1973 | Edwards | 259/7 |

*Primary Examiner*—Harvey C. Hornsby
*Assistant Examiner*—Robert Pous

[57] ABSTRACT

A mixer with a container and a cover mounted impeller and drive motor. A tiltable support for the container for decanting liquid and for emptying the container with and without the cover in position, and another support for lifting and lowering the cover. A mixer with provision for attaching a vacuum source to the container and for heating the cover to control condensation.

6 Claims, 4 Drawing Figures

TILT MIXER

This invention relates to mixers, particularly those of the heavy duty industrial type which are used in mixing paste and liquid-paste mixtures such as paints, inks, plastics, rubber and other related products. Mixers of this general type are shown in U.S. Pat. Nos. 3,746,267; 3,342,459; 3,307,793; and 3,244,410.

In some mixing operations, excess water or other liquid results and must be removed from the paste or cake. One example of such an operation is the conversion of a color concentrate into an ink.

It is object of the present invention to provide a mixer suitable for heavy duty mixing and including provision for decanting liquid and for drawing off liquid in vapor form.

It is a further object of the invention to provide such a mixture with a removable container which can be tilted for decanting and for emptying. An additional object is to provide such a mixture with a removable cover carrying one or more motor driven impellers, and means for removing the coupler from the container when desired. Another object is to provide such a mixer which can be operated with the cover in place in the upright and in the tilted position as desired.

Other objects, advantages, features and results will more fully appear in the following description.

The drawing merely shows and the description merely describes a preferred embodiment of the present invention which is given by way of illustration or example.

Figure 4:
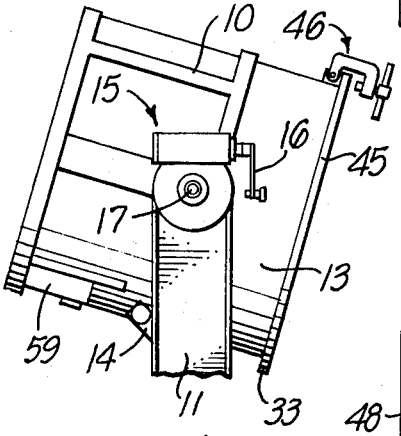
FIG. 4 is a partial sectional view similar to that of FIG. 3 showing the container in the emptying position.

The mixer in the drawing includes a cradle 10 pivotally mounted in upright 11 on a base plate 12. A container 13 may be positioned in the cradle 10 and fastened in place by a clamp lever 14. The cradle is tilted by a tilting mechanism 15 which may incorporate a worm turned by a crank 16 and a gear mounted on the cradle shaft 17 or a motor driven gear assembly or hydraulic ram.

A head 20 is raised and lowered by a ram 21 in a hydraulic cylinder 22 mounted on the base plate 12. The cylinder 22 and uprights 11 may be joined by horizontal braces 23. The cylinder 22 may also be braced by plates 24.

An impeller 30 is carried on a shaft 31 driven by a motor 32 mounted on a container cover 33. Another impeller 34 may be carried on another shaft 35 driven by another motor 36 carried on the cover 33. A bracket 40 on the motor 32 may be connected to a similar bracket 41 on the head 20, as by a bolt 42, for lifting and lowering the cover as the head is raised and lowered by the hydraulic cylinder. The cover 33 rests on a flange 45 of the container 13 and may be clamped thereto by suitable means, such as C clamps of the type shown at 46.

In the embodiment illustrated, the drive motors 32 and 36 are hydraulic motors energized from a power source 48 via lines 49, 50. Another line 51 may be mounted in the cover 33 for connecting the interior of the container to a vacuum source (not shown). In the preferred embodiment illustrated, means are provided for heating the lower surface of the cover. This may be accomplished by means of a steam or hot oil jacket on the upper surface or lower surface of the cover or by other suitable means, such as by an electrical resistance heater 55, energized via 56 from an electrical power source (not shown).

A lid 58 is hinged on the cover 33. A door 59 is mounted on the side of the container 13 adjacent the bottom.

A typical mixer of the type shown in the drawing may have a three hundred gallon capacity container and utilize 40 horse power variable speed drive motors, with the low speed shaft 31 operating in the range of 10 to 100 RPM and the high speed shaft operating in the range of 110 to 1200 RPM. Of course the mixer is not limited to these particular characteristics and containers of various sizes may be utilized with appropriate changes in power requirements.

Figure 2:
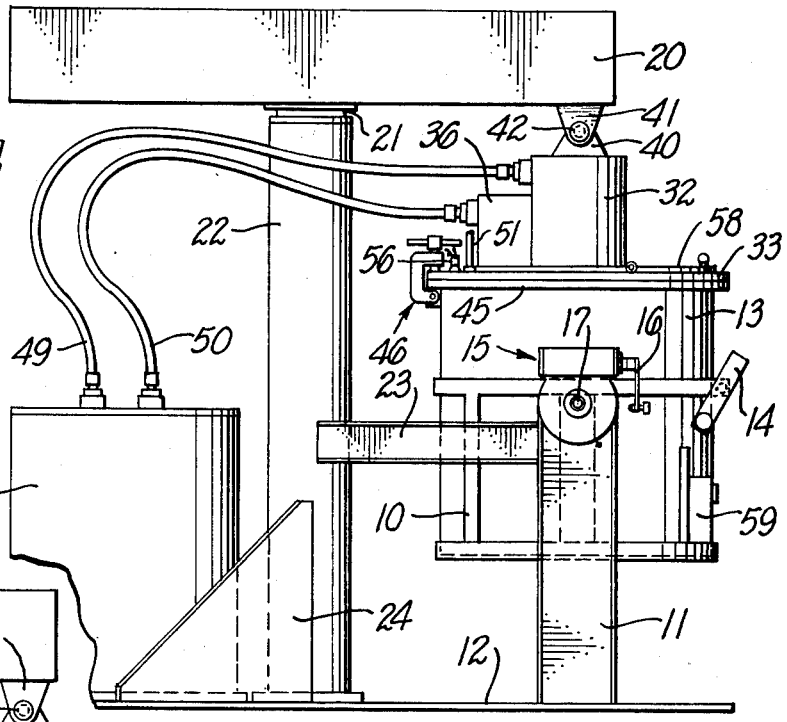
FIG. 2 is a view similar to that of FIG. 1 showing the container and cover in position for mixing.
Figure 1:
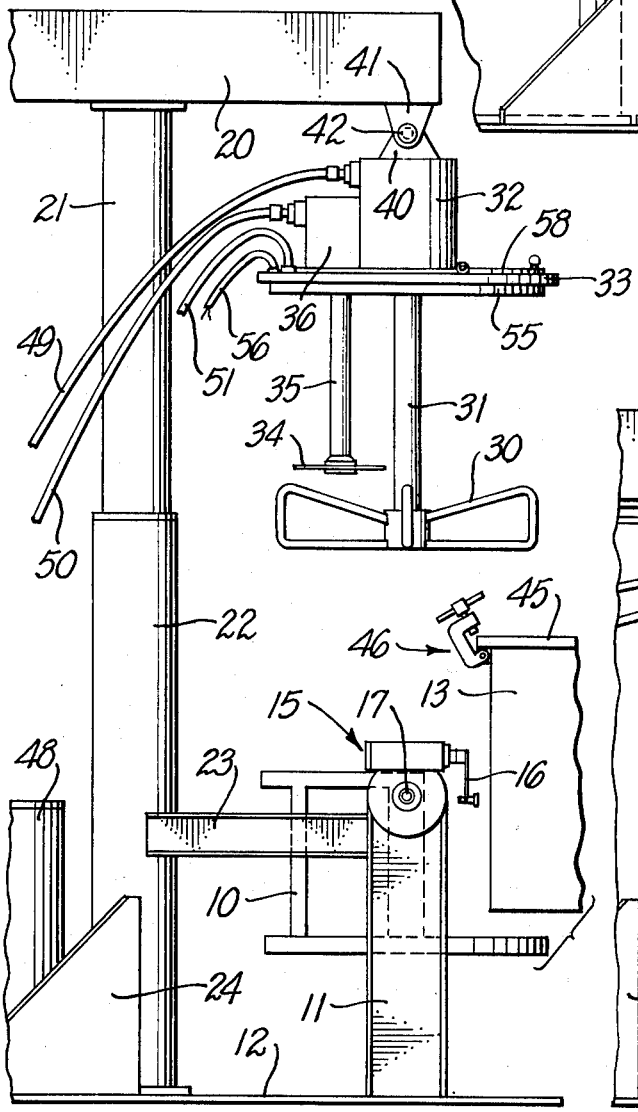
FIG. 1 is a side view of a mixer showing the cover in the upper position and incorporating the presently preferred embodiment of the invention.
Figure 3:
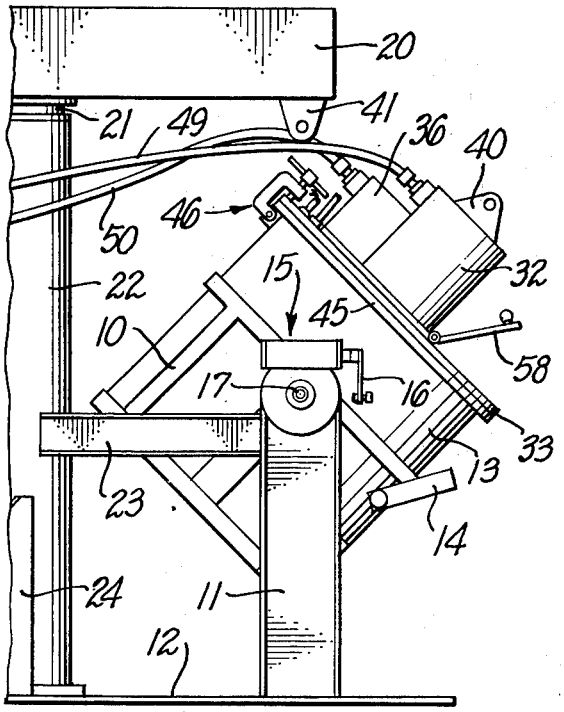
FIG. 3 is a partial view similar to that of FIG. 2 showing the container tilted in the decanting position.

In use, the materials to be mixed are placed in the container 13 either before or after the container is mounted in the cradle 10. The cover is then lowered from the position of FIG. 1 to the position of FIG. 2 and clamped in place, and the cover is disconnected from the head 20. Mixing proceeds as desired by appropriately controlling the motors 32 and 36. Excess liquid may be drained by tilting the container and opening the lid 58 as shown in FIG. 3. The mixing and draining steps may be repeated as often as desired, and ordinarily until all liquid is removed.

The vacuum processing may be initiated for final moisture and air removal. A vacuum source, such as a 40 cubic foot per minute vacuum pump, may be connected to the line 51 for withdrawing water vapor and air from the container. During the vacuum process, the cover may be heated by connecting an electric power source to the line 56 to prevent condensation of vapor on the cover. When a steam or oil jacket is provided on the cover for heating, cooling for reflux condensing may also be achieved by circulating a refrigerant. The container may be emptied by raising the gate 59, or by removing the cover and tilting the container as shown in FIG. 4.

One important use for the mixer of the present application is for removing excess water and other liquors from color presscake. In the manufacture of color pigments for inks, paints, plastics, etc., many of the products are precipitated from various minerals, metals, acid, water and alkaline that combine to form the pigment. The color pigment precipitation is then washed with water to further remove impurities. The precipitation is then put through a filter press or comparable process for further removal of water and other liquors. The resultant color is known as color presscake with an average moisture content of 40% to 60%.

A process known as flushing presscake is carried out by adding oils or varnishes or similar liquids to the presscake while being mixed in properly proportioned amounts. As a result the water, held in mechanical sponge-like suspension by the color pigment, is then flushed from the pigment and replaced by the oil or varnish-like liquid. The mixer is tilted for pouring off the flushed out water.

The operation is repeated until sufficient water is removed. The final removal of water and air is accomplished by vacuum removal. Most of the materials thus treated are extremely viscous during the flushing process. After the desired results have been achieved, additional oils and varnishes may be added with the high speed shaft blade operating to complete the final product, which may be done under vacuum. The finally "dispersed" product often is complete with no further processing being necessary for fineness of "grind".

We claim:

1. In an impeller type mixer, the combination of:

a cylindrical container having an axis and an open top and being supported on a first support means;

said first support means for said container mounted on a flat horizontally extending base plate;

said first support means comprising a pivotally mounted cradle type member connected to an upright base member and having at least one pair of parallel, horizontal, circular bands connected together at intervals around the circumference thereof by vertical connecting straps with a clamp thereon holding said container upright in place in said cradle member, said container being positionable in and laterally removable from said first support means;

a cover for said container for closing said open top;

at least one impeller and hydraulic drive motor mounted on said cover, with said impeller projecting into said container when said cover is mounted thereon;

a second support means for said cover, said second support comprising a vertical telescopic, hydraulic cylinder and piston having attached at the top thereof a horizontal elongate frame member, said cover, impeller and drive motor being suspended from and connectible to and disconnectible from said frame member of said second support;

said hydraulic cylinder and piston being capable of moving between upper and lower positions when said container axis is in the vertical position, with said impeller lifted clear of said container when said cover is connected to said second support and said second support is in said upper position;

a tilting mechanism connected between said base member and said first support means and being capable of tilting said first support means with said container therein and with said cover on said container and without said cover, said cover when on said tilted container being disconnected from said frame member to permit tilting of said frame member and cover, and said cover when not on said tilted container being connected to said frame member and lifted clear of said container by said cylinder and piston, said motor and impeller being operable when said cover is on said container both when said container axis is vertical and tilted; and a hydraulic power source mounted on said base plate with flexible hydraulic conduits leading from said power source and supplying power to said drive motor.

2. A mixer as defined in claim 1 including means mounted on said cover for connecting a vacuum source to said container.

3. A mixer as defined in claim 2 including means for heating the inner surface of said cover.

4. A mixer as defined in claim 2 including an electrical resistance heater mounted on the inner surface of said cover.

5. A mixer as defined in claim 1 including a lid on said cover for material transfer to and from said container.

6. A mixer as defined in claim 5 including a gate adjacent the bottom of said container for material transfer from said container.

* * * * *